US009872114B2

(12) United States Patent
Puder et al.

(10) Patent No.: US 9,872,114 B2
(45) Date of Patent: Jan. 16, 2018

(54) METHOD AND APPARATUS FOR FEEDBACK SUPPRESSION

(71) Applicant: SIVANTOS PTE.LTD, Singapore (SG)

(72) Inventors: Henning Puder, Erlangen (DE); Tobias Daniel Rosenkranz, Erlangen (DE); Tobias Wurzbacher, Fuerth (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 14/816,189

(22) Filed: Aug. 3, 2015

(65) Prior Publication Data

US 2016/0037269 A1 Feb. 4, 2016

(30) Foreign Application Priority Data

Aug. 1, 2014 (DE) ..... 10 2014 215 165

(51) Int. Cl.
*H04R 25/00* (2006.01)

(52) U.S. Cl.
CPC ..... *H04R 25/453* (2013.01); *H04R 2225/41* (2013.01); *H04R 2460/01* (2013.01)

(58) Field of Classification Search
CPC H04R 25/505; H04R 2225/43; H04R 25/606; H04R 19/04; H04R 1/1016;
(Continued)

(56) References Cited

U.S. PATENT DOCUMENTS 6,434,247 B1 8/2002 Kates et al.
6,876,751 B1 4/2005 Gao et al.
(Continued)

FOREIGN PATENT DOCUMENTS

EP 1228665 A2 8/2002
EP 2148525 A1 1/2010
(Continued)

OTHER PUBLICATIONS

Puder Henning et al.: "Controlling the adaptation of feedback cancellation filters—problem analysis and solution approaches", 2004 12th European Signal Processing Conference, IEEE, Sep. 6, 2004 (Sep. 6, 2004), pp. 25-28, XP-032760401, ISBN: 978-3-200-00165-7, found on the internet Apr. 3, 2015.

*Primary Examiner* — Norman Yu
(74) *Attorney, Agent, or Firm* — Laurence A. Greenberg; Werner H. Stemer; Ralph E. Locher

(57) ABSTRACT

A method and an apparatus reduce feedback in a hearing aid device. The method includes the step of acquiring a first feedback transfer function at a first point in time on a feedback path from a signal processing device via an electro-acoustic transducer, an acoustic signal path from the electro-acoustic transducer to an acousto-electric transducer and via the acousto-electric transducer back to the signal processing device. In a further step, a weighted mean value function is determined in a manner dependent on amplitude absolute values of the first feedback transfer function. A second feedback transfer function is estimated by an adaptive filter, wherein coefficients of the adaptive filter are determined in a manner dependent on the weighted mean value function. The adaptive filter is applied to a signal which is derived from an acoustic input signal of the acousto-electric transducer.

8 Claims, 4 Drawing Sheets

(58) Field of Classification Search
CPC H04R 2225/021; H04R 25/00; H04R 25/552; H04R 25/70; H04R 17/02; H04R 1/1083; H04R 1/326; H04R 25/50; H04R 29/001; H04R 2225/025; H04R 2430/01; H04R 3/04; H04R 11/02; H04R 2460/01; H04R 25/353; H04R 25/356; H04R 11/04; H04R 1/1008; H04S 2420/01; H04S 5/00; G10K 11/178
USPC ..... 381/23.1, 317, 321, 74, 318
See application file for complete search history.

(56) References Cited

U.S. PATENT DOCUMENTS

| | | | | |
|---|---|---|---|---|
| 8,295,519 | B2 | 10/2012 | Elmedyb et al. | |
| 9,124,986 | B2 | 9/2015 | Pedersen | |
| 2010/0177917 | A1* | 7/2010 | Van Der Werf ..... | H04R 25/453 381/318 |
| 2012/0328118 | A1 | 12/2012 | Pedersen | |
| 2013/0188796 | A1* | 7/2013 | Kristensen ..... | H04R 25/453 381/60 |

FOREIGN PATENT DOCUMENTS

| | | | |
|---|---|---|---|
| EP | 2541973 | A1 | 1/2013 |
| WO | 2010040863 | A2 | 4/2010 |

* cited by examiner

METHOD AND APPARATUS FOR FEEDBACK SUPPRESSION

CROSS-REFERENCE TO RELATED APPLICATION

This application claims the priority, under 35 U.S.C. §119, of German application DE 10 2014 215 165.1, filed Aug. 1, 2014; the prior application is herewith incorporated by reference in its entirety.

BACKGROUND OF THE INVENTION

Field of the Invention

The invention relates to a method for feedback suppression and to an apparatus for performing the method. The method according to the invention involves estimating a feedback transfer function, adapting coefficients of an adaptive filter for suppressing feedback, and applying the adaptive filter to a signal which is derived from an acoustic input signal of the acousto-electric transducer.

Hearing aid devices are portable hearing apparatuses which are used to support those with impaired hearing. In order to satisfy the numerous individual requirements, different designs of hearing aid devices are provided, such as behind-the-ear hearing aids (BTE), a hearing aid with an external receiver (RIC: receiver in the canal) and in-the-ear hearing aids, e.g. also concha hearing aids or canal hearing aids (ITE, CIC). The hearing aids mentioned by way of example are worn on the outer ear or in the auditory canal. Furthermore, however, bone conduction hearing aids and implantable or vibrotactile hearing aids are also commercially available. In this case, the damaged hearing is stimulated either mechanically or electrically.

In principle, the major components of hearing aids are an input transducer, an amplifier and an output transducer. The input transducer is generally an acousto-electric transducer, e.g. a microphone, and/or an electromagnetic receiver, e.g. an induction coil. The output transducer is usually realized as an electro-acoustic transducer, e.g. a miniature loudspeaker, or as an electromechanical transducer, e.g. a bone conduction earpiece. The amplifier is usually integrated into a signal processing device. Power is usually supplied by a battery or a rechargeable battery.

Owing to the great spatial proximity between the microphone and the electro-acoustic output transducer, there is always the risk of an acoustic signal being transmitted as sound through the air, whether via a ventilation opening, a gap between the wall of the auditory canal and the hearing aid device or an earpiece of the hearing aid device or in the interior of the hearing aid device or else as structure-borne sound via the hearing aid device itself. In this case, if the total gain of a feedback loop resulting from the signal processing in the hearing aid device and the damping on the feedback path between output transducer and microphone is greater than 1, then given a suitable phase shift of a signal, in particular if the phase shift is 0 or integral multiples of 2*pi, along the feedback loop an oscillation can arise which is manifested to the wearer as unpleasant whistling.

For suppressing feedback noises in hearing aid devices, various measures are known from the prior art. One possibility is to provide an adaptive filter in the hearing aid device, the coefficients of which adaptive filter are derived from a response function of the feedback path, the response function being ascertained in various ways. In this case, the respective change in coefficients of the adaptive filter is determined by a mathematical method according to a normalized least mean square (NMLS). In this case, the speed at which the adaptive filter can adapt is influenced by a step size μ. If the step size is large, the adaptive filter can follow rapidly; if the step size is small, then the filter maps the input function better in the case of small changes.

The publication C. Antweiler, A. Schiffer and M. Dörbecker, "Acoustic Echo Control with Variable Individual Step Size", Proc. IWAENC, pages 15 to 18, Norway, 1995, discloses for example weighting the step size μ in each case for coefficients that are assigned to a relatively long time delay with an exponential decrease in a manner dependent on the time delay. This is derived from the general insight that an excitation of a damped oscillation decreases exponentially over time. Since real impulse responses are composed of a multiplicity of different damped oscillations with different decay times, deviations arise.

The document by Benesti, Sondhi, and Huang, entitled "Handbook of Speech Processing", chapter 6.6.4, page 114, Springer Verlag, 2008, discloses weighting a coefficient with a vector that is proportional to a preceding value of the same coefficient. However, if the feedback path and thus impulse response change, then the adaptive filter converges slowly for coefficients having formally small values.

SUMMARY OF THE INVENTION

Therefore, the object of the present invention is to provide a method and an apparatus in which feedback suppression is improved.

The method according to the invention relates to a method for reducing feedback in a hearing aid device. The hearing aid device contains an acousto-electric transducer, a signal processing device, a feedback suppression device and an electro-acoustic transducer.

One step of the method according to the invention involves ascertaining a first feedback transfer function at a first point in time. The feedback transfer function maps feedback paths from the signal processing device via the electro-acoustic transducer, an acoustic signal path from the electro-acoustic transducer to the acousto-electric transducer and via the acousto-electric transducer back to the signal processing device. The acoustic signal path is dependent on the environment of the head and changes for example when the wearer moves. Ascertaining can comprise for example measuring different feedback transfer functions in a laboratory or else estimating by approximation methods such as NLMS during the operation of the hearing devices aid on the wearer's ear.

One step of the method according to the invention involves determining a weighted mean value function and/or a plurality of impulse response parameters in a manner dependent on amplitude absolute values of the first feedback transfer function. For this purpose, by way of example, it is possible to form an envelope function for the absolute values of the amplitudes or a function of the amplitude squares which are smoothed by a low-pass filter or a bandpass filter and which reflects energy of the impulse response via a time delay with respect to the impulse excitation.

In particular, the impulse response parameters are resolved via a time delay with respect to the impulse excitation, that is to say that different impulse response parameters are determined for different values for the time delay. In this case, individual impulse response parameters are preferably determined in a manner dependent on different function values of the envelope function for the absolute values of the amplitudes or of the function of the amplitude squares which is smoothed by a low-pass filter or a bandpass filter. In particular, the impulse response parameters are determined from the weighted mean value function dependent on the first feedback transfer function. In this case, the weighted mean value function forms a weighted mean value over the first feedback transfer function and further feedback transfer functions, wherein the averaging is preferably carried out point by point with respect to the individual time delays according to which the feedback functions are resolved.

The impulse response parameters preferably have a direct dependence on the impulse response of a feedback path which is mapped by the first feedback transfer function or by a weighted mean value function of a plurality of feedback transfer functions. In this case, the impulse response of a feedback path is given in particular by a time-resolved amplitude of a signal excited by a test impulse in the feedback path.

Another step of the method involves estimating a second feedback transfer function by use of an adaptive filter. Preferably, the estimating is carried out at a second, different point in time. In this case, coefficients of the adaptive filter for suppressing a feedback signal are determined in a manner dependent on the weighted mean value function and/or updated in a manner dependent on the impulse response parameter, wherein an adaptation speed of the adaptive filter is formed by a function of the impulse response parameters.

By way of example, an estimating method involves forming a current estimation function from an estimated value of the past and an estimation of the deviation of the estimated value of the past from the actual values. For estimating an impulse response it is possible, for example, to take into account in each case portions with a different delay in different coefficients. The weighting of the change in the different coefficients can in turn be weighted in a dependent manner by empirical values resulting from the value functions of exemplary or past impulse responses.

In this case, the adaptation speed of the adaptive filter is by definition the speed at which the adaptive filter reacts to changes in the feedback transfer function to be estimated and thus "adapts" the latter in response to the changes. At a high adaptation speed the adaptive filter reacts rapidly to changes in the feedback path to be mapped by the feedback transfer function, as a result of which excitations which are caused by the changes can be rapidly suppressed. At a low adaptation speed, however, the adaptive filter is stabler, such that owing to the higher inertia in an output signal audible artifacts as a result of the feedback suppression can be better avoided. By updating the coefficients of the adaptive filter in such a way that the adaptation speed is formed by a function of the impulse response parameters it is possible to control the adaptation behavior by the impulse response parameters.

In particular, in this case, the function of the impulse response parameter for the adaptation speed is such that for time delays with regard to an impulse excitation for which there is a comparatively strong impulse response of a feedback path underlying the impulse response parameters the adaptive filter adapts rapidly to changes in the feedback path, while for time delays with regard to an impulse excitations for which there is no appreciable impulse response of a feedback path underlying the impulse response parameters the active filter adapts more slowly to changes in the feedback path. This is achieved, for example, by using as impulse response parameters a monotonic function of the temporally smoothed amplitude absolute values of the impulse response in the underlying feedback path, and form the adaptation speeds for different time delays with regard to an impulse excitation in each case by the same monotonic function of the corresponding impulse response parameter.

What is achieved thereby is that the adaptive filter which uses its coefficients to estimate the second feedback transfer function makes changes to the estimated feedback path particularly rapidly in particular where the latter has a high impulse response. By virtue of the fact that, in this case, the impulse response parameters are not ascertained from the second feedback transfer function itself, but rather on the basis of the first feedback transfer function or a weighted mean value function, which is preferably to be selected as a typical representative of a feedback transfer function that is possible in the given hearing situation with the corresponding feedback path, and incorrect adaptation, for example on account of terminal excitations in the feedback path, can be avoided since the updating of the coefficients is no longer dependent only on the estimation, which after all is erroneous, but rather is now also dependent on an external reference.

Another step of the reference according to the invention involves applying the adaptive filter to a signal which is derived from an acoustic input signal of the acousto-electric transducer. By way of example, it is conceivable, by use of the adaptive filter, to filter out or suppress a feedback portion from the acoustic signal by the adaptive filter mixing with the audio signal a signal which is approximately identical to the feedback portion and has a inverse sign.

By virtue of the fact that the method according to the invention, for determining the coefficients, uses experiences from a first feedback transfer function in the form of the weighting for determining a current set of coefficients, it advantageously allows a faster and more accurate estimation of the current feedback transfer function and thus a more effective and more accurate suppression of feedback with reduction of artifacts by the feedback suppression. The coefficients of the adaptive filter are advantageously adapted such that a rapid adaptation is ensured in those regions of the feedback impulse response which include a large amount of energy, whereas regions with low energy are subject only to a slow adaptation. Regions with low energy do not contribute to the risk of feedback-governed whistling, and so in these regions it is important to provide for as much freedom from artifacts as possible by a slow adaptation. Use of an envelope function ensures that regions in proximity to zero crossings in the feedback impulse response do not erroneously lead to a slow adaptation. Averaging over time ensures that momentary fluctuations do not lead to incorrect adaptations.

The hearing aid device according to the invention for performing the method shows the advantages of the method according to the invention.

Further advantageous developments of the invention are specified in the dependent claims.

In one conceivable embodiment of the method according to the invention, a multiplicity of feedback transfer functions are ascertained at different points in time and the weighted mean value function is determined in a manner dependent on the multiplicity of solar cells.

In this regard, it is advantageously conceivable that the feedback suppression device forms a mean value function from feedback transfer functions over a longer period or, in particular, takes account of feedback transfer functions having greatly different properties.

In one possible embodiment of the method according to the invention, ascertaining the first feedback transfer function is carried out by estimating the feedback transfer functions in the hearing aid device.

Advantageously, the hearing aid device can thus adapt to the wearer's environment during operation and offer the wearer a better functionality with less feedback and fewer artifacts.

In one conceivable embodiment of the method, ascertaining the first feedback transfer function is carried by measuring the first feedback transfer function.

Advantageously, measuring makes it possible to detect specific hearing situations more accurately and also to provide a mean value function for the hearing aid device even before the first use by the wearer, such that a use for the wearer without a training phase becomes possible.

In one conceivable embodiment of the method, the feedback suppression device is implemented as part of the signal processing device, such that the signal processing device performs the steps of the method.

Advantageously, it is thus possible to reduce the number of components in the hearing aid device and to make use of synergies when determining the coefficients, for example by accessing common data.

In one conceivable embodiment of the method according to the invention, the latter is performed in a plurality of disjoint or partly overlapping frequency ranges.

That makes it possible for the hearing aid device to react to different feedback conditions at different frequencies and to adapt the method thereto. By way of example, owing to higher damping of an excited oscillation at high frequencies shorter filter lengths are conceivable or at lower frequencies a lower sampling rate is conceivable.

In one possible embodiment of the method, the method is continued after the step of applying the adaptive filter with a step of determining a weighted mean value function, wherein the second feedback transfer function is used jointly with the first feedback transfer function for forming the weighted mean value function and a new second feedback transfer function is estimated.

In this regard, advantageously, the adaptive filter and the step size can be permanently updated, such that a fast convergence with small artifacts can be achieved even under changing feedback conditions.

In one preferred embodiment of the method, the impulse response parameters are ascertained by a smoothing function of the amplitude absolute values in a manner dependent on the first feedback transfer function. Dependence on the first feedback transfer function encompasses the first feedback transfer function and also a weighted mean value function of different feedback transfer functions. In particular, in this case, the feedback transfer function or the weighted mean value function is embodied as an impulse response function, such that a smoothing function of the amplitude absolute values constitutes a preferably temporal smoothing of the absolute value of the impulse responses of the feedback path corresponding to the feedback transfer function for different time delays with regard to the impulse excitation. Preferably, in this case, the smoothing function is embodied as an envelope of the amplitude absolute values. Preferably, the envelope is normalized relative to a reference value dependent on the adaptive filter or relative to a maximum value for the amplitude absolute values. What can be achieved by a preferably temporal smoothing of a function of the amplitude absolute values which underlies the impulse response parameters is that an impulse response parameter is not influenced by a zero crossing—falling randomly on the corresponding time delay—of an oscillating amplitude with high absolute values in the corresponding region and, consequently, an adaptation speed would not incorrectly be chosen to be too low for the corresponding time delay.

In a more expedient embodiment, for a monotonic decrease in the amplitude absolute values in the argument of the smoothing function by means of the impulse response parameters the adaptation speed of the adaptive filter is reduced in this region.

The first feedback transfer function or the weighted mean value function underlying the impulse response parameters preferably constitutes a typical representative of a feedback transfer function that is possible in the given hearing situation with a corresponding feedback path. If the amplitude absolute values decrease monotonically in such a function for a specific region of the time delay with regard to an impulse excitation, this means that such a feedback path usually yields contributions to the feedback which correspondingly decrease in this region. Accordingly, the adaptation speed in the estimation of the second feedback transfer function for these regions is also reduced.

What can advantageously be achieved as a result is that owing to an incorrect adaptation, for example as a result of a terminal excitation in the input signal, the adaptation speed is not erroneously increased unnecessarily in these regions, which might lead to undesired artifacts in an output signal.

In a further advantageous embodiment variant, the coefficients of the adaptive filter are updated by use of an NLMS algorithm, wherein the entries of a vector-valued step size of the NLMS algorithm for updating the coefficients of the adaptive filter are formed on the basis of the impulse response parameters and wherein the impulse response parameters are ascertained on the basis of a smoothing function of the amplitude values in a manner dependent on the first feedback transfer function.

An NLMS ("Normalized Least Mean Squares") algorithm is a filter which is used particularly often for suppressing feedback and which updates existing coefficients of the filter in a manner dependent on an output signal and an error signal by means of a step size. The individual coefficients of the filter are applied thereafter with their corresponding time order—that is to say the time delay with regard to an impulse excitation—to a signal derived from the input signal. By virtue of the step size for updating the coefficients being performed as a vector on the basis of the impulse response parameters, the step size with which each coefficient is updated for an adaptation to a change can be chosen in a manner dependent on the impulse response in the feedback path, such that, on the one hand, the adaptation takes place rapidly enough to detect sudden changes as a result of excitations in the input signal, but on the other hand artifacts can be avoided.

The apparatus according to the invention shares the advantages of the method according to the invention.

The above-described properties, features and advantages of this invention and the way in which they are achieved will become clearer and more clearly understood in association with the following description of the exemplary embodiments which are explained in greater detail in association with the drawing.

Other features which are considered as characteristic for the invention are set forth in the appended claims.

Although the invention is illustrated and described herein as embodied in a method and apparatus for feedback suppression, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
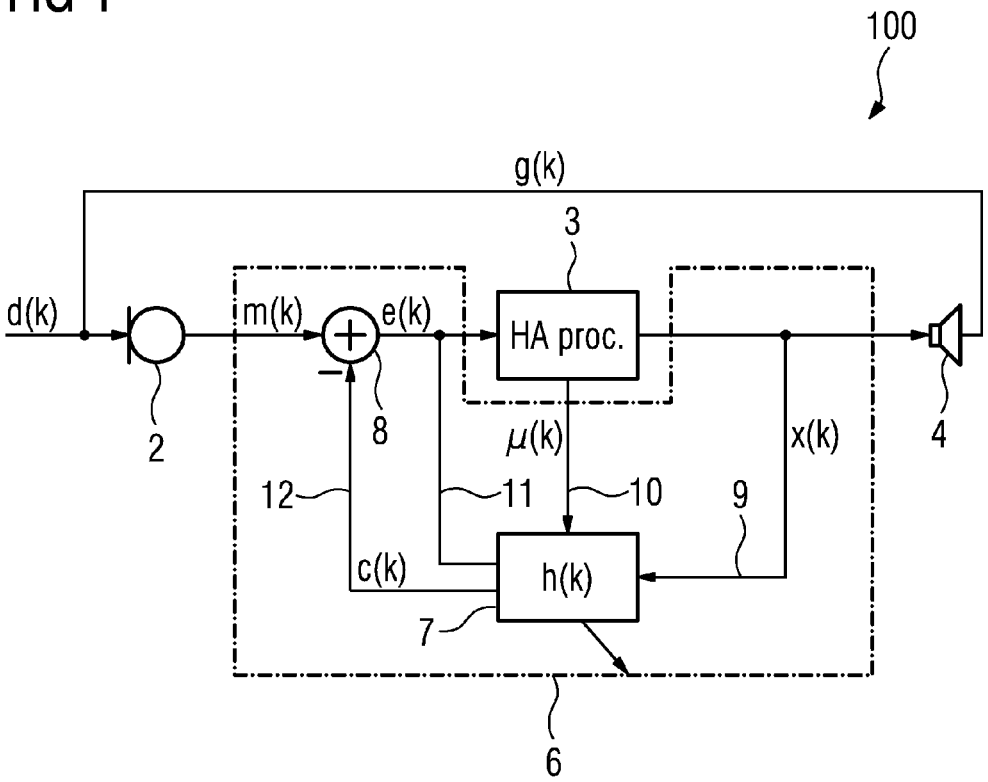
FIG. 1 is an exemplary schematic illustration of a hearing aid device according to the invention.

Referring now to the figures of the drawings in detail and first, particularly to FIG. 1 thereof, there is shown a hearing aid device 100 according to the invention as a schematic illustration in function blocks. The hearing aid device according to the invention contains an acousto-electric transducer 2, which converts a mechanical oscillation, usually recorded as air-born sound d(k), into an electrical signal m(k). The acousto-electric transducer 2 is usually one of a plurality of microphones, normally of capacitive design and in some instances also of micromechanical design as MEMS microphone composed of silicon. It is conceivable here for the signals of a plurality of microphones to be interconnected as a microphone having a directional characteristic. In this case, the signal m(k) is preferably a signal having a directional characteristic.

The hearing aid device 100 furthermore has a signal processing device 3, which is configured to amplify an incoming signal e(k) preferably in a frequency-dependent manner such that a hearing deficiency of a wearer can be compensated for and soft tones below the wearer's hearing threshold are raised into a range above the wearer's hearing threshold. For this purpose, the signal processing device 3 can have a filter bank, for example.

Conceivable further functions of the signal processing device 3 are dynamic range compression, classification of hearing situations, noise suppression, control of directional characteristics of the microphone, binaural signal processing, if the hearing aid device 100 is signal-connected to a second hearing aid device 100 via a communication interface (not illustrated).

Furthermore, the hearing aid device contains an electro-acoustic transducer 4, which is embodied as a loudspeaker or receiver. In the case of a behind-the-ear hearing aid device 100, the electro-acoustic transducer 4 can be arranged in a housing behind the ear and be transmitted the sound via a sound tube to an earpiece in the auditory canal of the wearer. In the case of a BTE hearing device, it is also conceivable for the electro-acoustic transducer 4 to be arranged in the auditory canal of the wearer and to receive a signal to be output via an electrical signal connection. Finally, the hearing aid device 100 can also be an in-the-ear or CiC (complete in channel) hearing aid device, such that all the components of the hearing aid device are arranged on or in the auditory canal of the wearer.

Between the electro-acoustic transducer 4 and the acousto-electric transducer 2 there is always a feedback path g(k) via which acoustic energy can be transmitted back to the acousto-electric transducer 2. The feedback path can be formed by the air, for example by a gap between the auditory canal and a seal of the auditory canal (e.g. an ear shell or an "ear dome"), or else as structure-born sound transmission by a housing of the hearing aid device 100. A combination of both routes is also conceivable. In this case, the properties of the feedback path are also dependent on the environment of the wearer's head, for example on reflection at a wall or an automobile window or else a telephone receiver in proximity to the ear. A damping of the feedback path is greatly frequency-dependent in this case. If the total gain via the electro-acoustic transducer 4, the feedback path g(k), the acousto-electric transducer 2 and the signal processing 3 is greater than 1 taking account of the phase, the feedback whistling occurs.

In order to prevent or at least reduce such feedback whistling the hearing aid device 100 contains a feedback suppression device 6, which has an adaptive filter 7 and a mixer 8 in the embodiment illustrated. The adaptive filter 7 receives the input signal e(k) fed to the signal processing device 3 via a first signal line 11 and the signal x(k) output by the signal processing device via a second signal line 9. Furthermore, the adaptive filter 7 is connected via a third signal line 10 to the signal processing device 3 in order to detect the effect thereof for processing the input signal e(k). This can take place, for example, by a communication of processing parameters.

The adaptive filter 7 processes the signals fed to form a compensation signal c(k), which is mixed with the electrical signal m(k) by a mixer 8 in order to reduce feedback. More specific details concerning the manner in which the compensation signal c(k) is generated are explained in greater below with regard to FIG. 2.

It should be noted that, in particular, the division of functionalities in FIG. 1 is merely by way of example. It is likewise conceivable for the feedback suppression unit 6, in contrast to the illustration in FIG. 1, not to be embodied as dedicated function blocks 7 and 8, but rather merely as program-controlled functions in the signal processing device 3, or else as hardware-implemented circuits therein. Moreover, it is conceivable for the adaptive filter 7 not to carry out filtering by generating a compensating signal c(k) and mixing it with the electrical signal m(k) in order to reduce a feedback signal by destructive interference, but rather to be provided as a subtractive filter itself in the signal path m(k). Moreover, the signals x(k) and e(k) can be removed from the signal flow at different locations, without departing from the principle of the invention. It is conceivable, for example, for the adaptive filter 3 itself to ascertain the influence of the signal processing device 3 by comparison of the signals e(k) and x(k). Likewise, however, it is also considerable for the adaptive filter 7 to receive all information concerning the function of the signal processing 3 via the signal connection 10, but in return only one of the signals e(k) or x(k).

Figure 2:
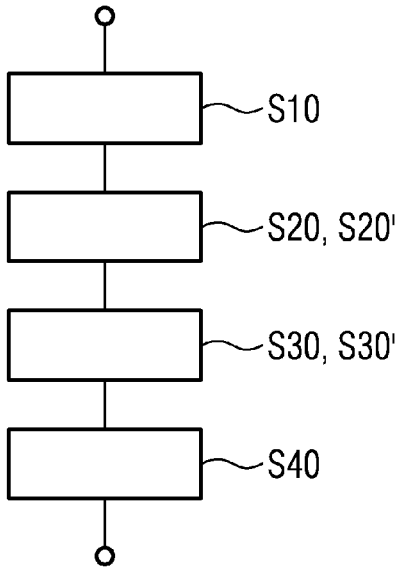
FIG. 2 is a flow diagram of a method according to the invention.

FIG. 2 shows an exemplary sequence of a method according to the invention proceeding on a hearing aid device from FIG. 1.

A step S10 involves acquiring a first feedback transfer function at a first point in time on a feedback path from the signal processing device 3 via the electro-acoustic transducer 4, an acoustic signal path g(k) from the electro-acoustic transducer 4 to the acousto-electric transducer 2 and via the acousto-electric transducer 2 back to the signal processing device 3.

In this case, it is conceivable for the feedback transfer function to be measured by a hearing device acoustician in a measuring box or in a laboratory by measurement on the wearer or an artificial head. In these embodiments, the feedback transfer function can be measured more accurately since input and output signals can in each case be detected externally and processed with one another. It is conceivable here to represent typical hearing environments, such as making a telephone call using a cell phone or sitting in an automobile with the ear in proximity to a window.

Preferably, a plurality of feedback transfer functions are measured for typical environments.

Likewise, however, it is also conceivable for the feedback transfer function to be estimated in the hearing aid device itself while it is being worn, i.e. to be acquired by approximation functions explained for step S30 or S30'. The feedback transfer functions acquired in this way advantageously have no influence on the measurement and can correspond to everyday situations of the wearer.

Figure 3:
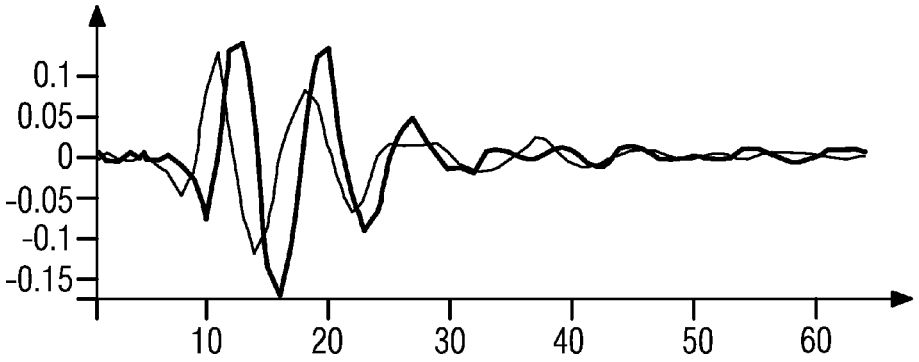
FIG. 3 is a graph showing exemplary impulse responses of feedback paths.

FIG. 3 illustrates two exemplary impulse responses as a possible form of representation of a feedback transfer function. In this case, impulse response and feedback transfer function are equivalent to one another in the sense that one can respectively derive from the other unambiguously by use of mathematical methods. The time in multiples of a sampling circle is indicated on the x-axis, and a normalized amplitude on the y-axis. In this case, the x-axis indicates a time delay with respect to an excitation impulse.

A step S20 involves determining, from the first feedback transfer functions acquired, a weighted mean value function in a manner dependent on amplitude absolute values of the first feedback transfer function. A step S20' involves ascertaining a plurality of impulse response parameters in a manner dependent on amplitude absolute values of the first feedback transfer function. If step S20' is carried out as an alternative to step S20, then the impulse response parameters are ascertained directly from the feedback transfer function acquired in step S10. If step S20' is carried out directly after step S20, then the impulse response parameters are ascertained from a weighted mean value function of a plurality of feedback transfer functions which contains the first feedback transfer function acquired in step S10.

Figure 4:
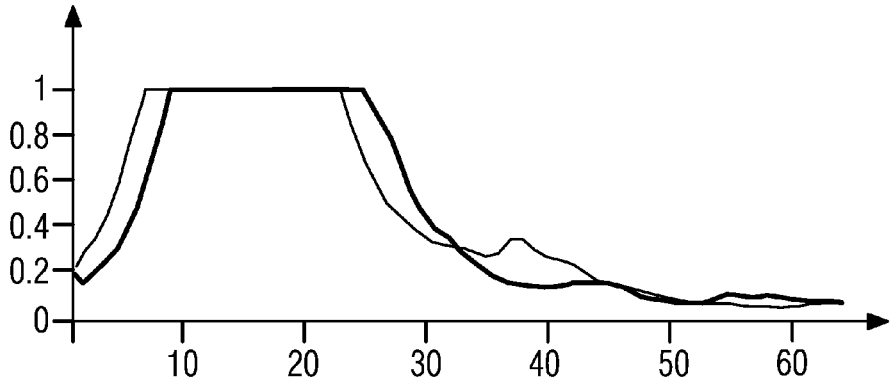
FIG. 4 is a graph showing exemplary weighted mean value functions with respect to the impulse response.

FIG. 4 shows firstly for each impulse response a function which is generated by normalizing a function in a manner dependent on the amplitude absolute values. The functions therefore only have a positive sign. For the large amplitudes at the beginning, the function value is set to be equal to 1 in the sense of a limitation.

A mean value can be implemented in the sense of temporal smoothing of the feedback transfer function for example by an envelope of the positive amplitudes being formed. A low-pass filter or bandpass filter over a function of the amplitude squares is also conceivable.

A mean value can additionally be formed in the sense of an arithmetic averaging or other averaging for example by adding a plurality of function values of different feedback transfer functions and dividing by the number of acquired functions, provided that a plurality of feedback transfer functions were acquired. This can be carried out for example by measurement or by an iteration of the method over a plurality of the feedback transfer functions. However, other forms are also conceivable, such as the weighting of a function during averaging in a manner dependent on the age of the corresponding feedback transfer function.

If the acquired feedback transfer function in step S10 is a measured function, then the mean value function can already be calculated outside the hearing aid device 100 in a measuring apparatus and be transmitted to the hearing aid device 100. By contrast, if a feedback transfer function estimate in the hearing aid device 100 is involved, then the weighted mean value function is preferably determined in the hearing aid device 100, e.g. by the feedback suppression device 6.

A second step S30 or S30' of the method according to the invention involves estimating a second feedback transfer function.

Preferably, the adaptive filter 7 models the time-dependent feedback transfer function as a time-dependent impulse response g(k) of the feedback path.

One example of an estimation method is the updating of coefficients of an adaptive filter by the NLMS algorithm. From a value at a point in time k, the value at a point in time k+1 is estimated according to the following formula:

$$h(k+1)=h(k)+\mu[(e^*(k)x(k))/(x^*(k)x(k))].$$

In this case, k indicates a discrete timescale, x is the input value of the feedback suppression device, e=m−c is the error signal indicated as a difference between the microphone signal m and the compensation signal c, μ is a step size which controls an adaptation speed of the filter, and * denotes the complex conjugate of a value. In this case, h, x and μ are vectors in a space whose dimensionality is given by the length of the filter or the number of coefficients: $h(k)=[h0(k), h1(k), h2(k), \ldots, hN(k)]$, wherein N is the number of coefficients in the model of the estimated function.

In this respect, also see:

a) S. Haykin, Adaptive Filter Theory. Englewood Cliffs, N.J.: Prentice-Hall, 1996.

b) Toon van Waterschoot and Marc Moonen, "Fifty years of acoustic feedback control: state of the art and future challenges", Proc. IEEE, vol. 99, no. 2, February 2011, pp. 288-327.

Other conceivable methods for estimating a feedback transfer function are:

a) LMS—Least mean squares b) RLS—Recursive least squares c) Affine Projection

In this case, the coefficients of the adaptive filter for suppressing a feedback signal are adapted to the second evaluation device or, in other words, the evaluation device is modeled by the coefficients, wherein a change in the coefficients is weighted in a manner dependent on the mean value function or the impulse response parameters. For adapting the coefficients, a correction value is weighted with a weighting factor or a step size. In the embodiment illustrated, this weighting is carried out by means of the step size μ, which, as explained above, are incorporated in the estimation of the evaluation device modeled by coefficients. The weighting factor is derived from the mean value function by the scanners. In the simplest case, it could be the value of a mean value function itself as illustrated in FIG. 4. The value of a weighting factor μ(k) is then for example a function value of a function—illustrated in FIG. 4—for the value k on the x axis.

Figure 5:
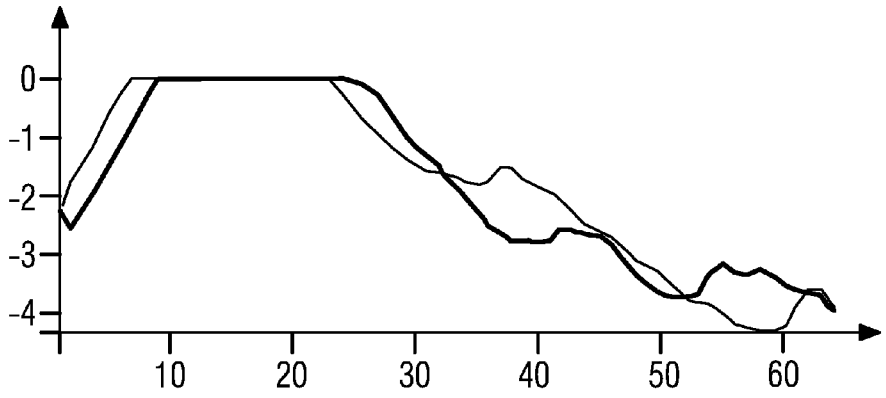
FIG. 5 is a graph showing exemplary weighting coefficients.

Preferably, as in FIG. 5, a step size is derived from the mean value function from FIG. 4. In FIG. 5, for this purpose, a scale in accordance with the common logarithm log 10 is plotted instead of a linear, normalized scale to 1. In this way, the dynamic range of the step size is significantly greater, such that a rapid convergence is achieved in the case of large values of the impulse response in FIG. 3, while a high accuracy in the adaptation and hence small artifacts occur in the case of small values.

It is also conceivable, however, for the process of estimating the second evaluation device to be carried out separately from a weighing of the coefficients successively in a method according to the invention.

Finally, a step S40 involves applying the adaptive filter to a signal which is derived from an acoustic input signal of the acoustic-electric transducer. In this case derived should be understood to mean any signal processing conceivable in a hearing aid device, such as, for example, A/D conversion, amplification, including in a frequency-dependent manner, formation of a directional effect or else other functions that are possible in the signal processing 3. FIG. 1 illustrates the process of applying the filter by use of the compensation signal c(k), which constitutes an estimated feedback signal and is added with opposite signs to the signal m(k) of the microphone, such that the signal of the adapted filter and the feedback portion of the microphone signal m(k) ideally cancel one another out.

In one preferred embodiment of the method, the latter is continued after step S40 with step S20, wherein the second feedback transfer function is used jointly with the first feedback transfer function for forming the mean value function and a new second feedback transfer function is estimated in step S30.

In one preferred embodiment of the method according to the invention, steps S10 to S40 are performed in each case in separate or only partly overlapping frequency bands, such that different feedback conditions at different frequencies can be optimally suppressed in each case. For this purpose, by way of example, it is possible to provide a filter bank in the feedback suppression device 6 or else to use a filter bank in the signal processing device 3.

During the suppression of feedback by an adaptive filter, an excitation in the form of a tonal input signal can lead to an incorrect adaptation. In the example of the NLMS algorithm cited, the adaptive filter yields as a solution the feedback transfer function of the feedback path respectively present, to which is added an error term that is dependent on the autocorrelation of the input signal. Owing to the comparatively high autocorrelation of a tonal input signal, in this case an incorrect adaptation in response to the excitation in the form of the tonal input signal usually cannot be sufficiently depressed with conventional means.

The method described now yields a satisfactory solution to this. Incorrect adaptations owing to excitations in the input signal are crucially suppressed, while the adaptation speed is nevertheless sufficiently high for customary changes in the feedback path. Therefore, a high stability of the feedback suppression is achieved, which has an improved sound quality, without any impairment here of the reactivity with regard to changes in the feedback path. Consequently, it is no longer necessary to choose a compensatory compromise between the sound quality and the adaptability to changes in the feedback path.

Figure 6:
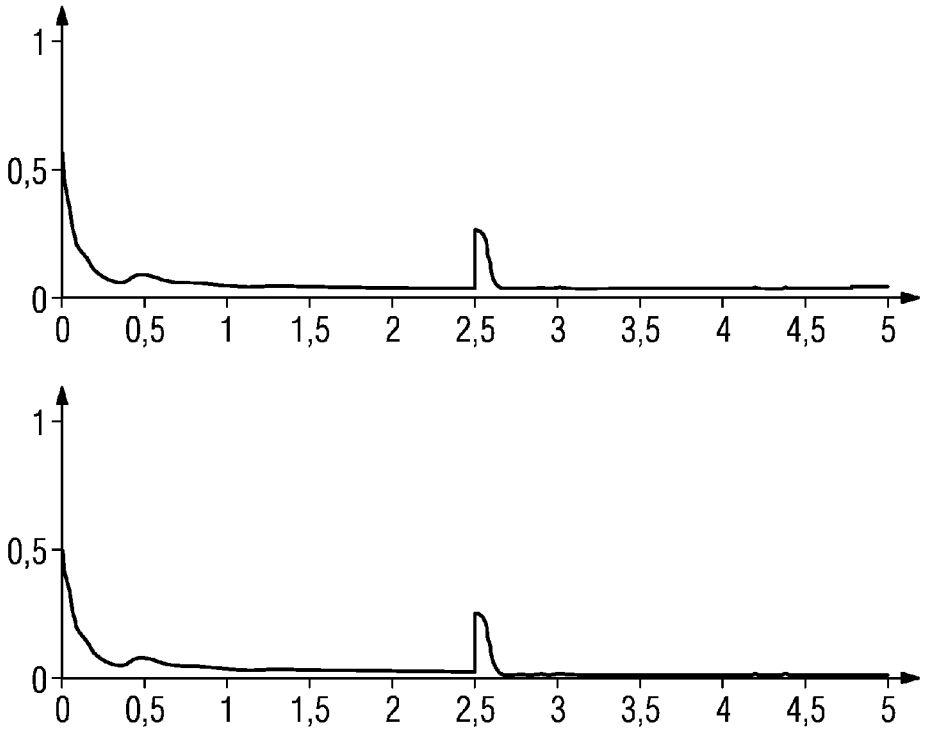
FIG. 6 is a graph showing two diagrams of the comparative reactivity of an adaptation with vector-valued step sizes.

The behavior or the reactivity with regard to changes in the feedback path which the method allows is illustrated on the basis of two diagrams in FIG. 6. The diagrams in each case show the system distance, defined as $\|g(k)-h(k)\|/\|g(k)\|$, plotted against a time axis scaled in seconds. In this case, the system distance is a measure of the extent to which the coefficients h(k) and the adaptive filter correspond to the actual impulse response g(k) in the feedback path. A good correspondence is characterized by values close to zero for the system distance. The excitation underlying the feedback path consists in white noise. For the upper graph, a uniform step size μ was used in each case in the updating of the coefficients h(k) of the adaptive filter. For the lower graph, in the updating of the coefficients the step size μ was adapted to the impulse response of a typical feedback path in the manner described across the individual coefficients.

After 2.5 seconds, an instantaneous change takes place in the feedback path. It can be read from the respective diagram that the reactivity to this change in the feedback path is not impaired by the use of individual step sizes for the different coefficients h(k) of the adaptive filter, even though the step size is considerably reduced by this means for a large proportion of the coefficients. This is owing to the fact that the reduction of the step size—and thus the reduction of the reactivity of the filter—takes place for coefficients which represent regions of a low impulse response in a typical feedback path and therefore make only an insufficient contribution to the overall behavior of the feedback path.

Figure 7:
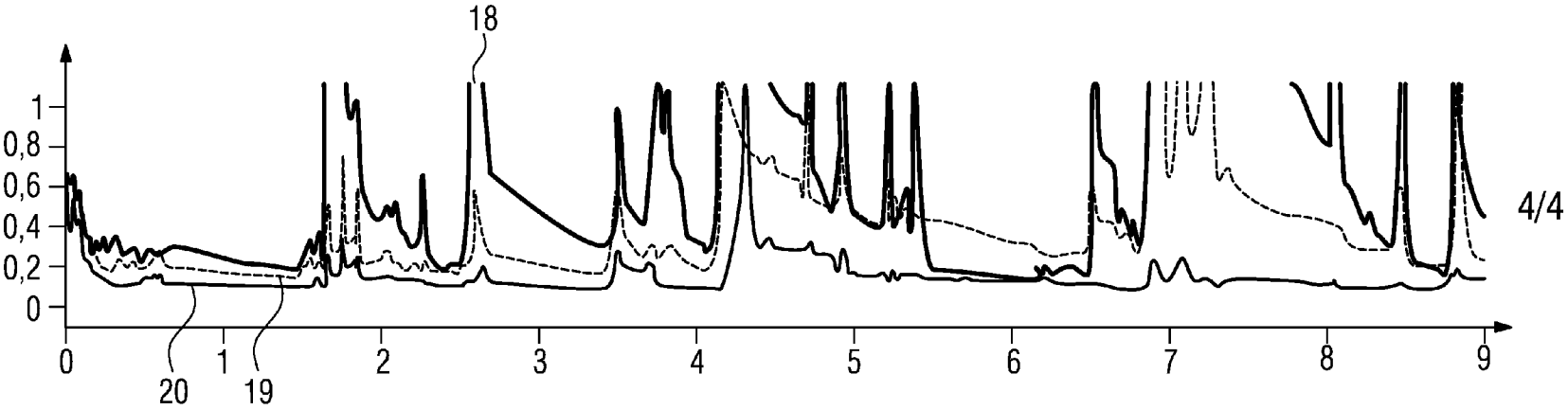
FIG. 7 is a graph showing comparative instability of an adaptation with vector-valued step sizes.

The improvement of the stability of the feedback suppression, that is to say in particular the reduction of incorrect adaptations, as a result of the updating of coefficients h(k) of the adaptive filter by individual step sizes becomes clear from the diagram in FIG. 7: once again the system entity is plotted here against a time axis scaled in seconds, wherein the three scenarios illustrated are given by: the traditional NLMS algorithm and an updating of the coefficients with a constant step size (upper line 18), an updating of the coefficients by individual, but not time-dependent step sizes (middle line 19), and an updating of the coefficients by individual, time-dependent step sizes in a manner dependent on a feedback path "learned" by weighted averaging (lower line 20).

In the first case, as can be discerned on the basis of the system entity represented by the upper line 18 considerably incorrect adaptations occur during the entire time period. The mean value for the system distance is 0.98. As a result of the individual step sizes which are used for the second case (middle line 19) the incorrect adaptations were able to be considerably reduced; the mean system distance has available 0.40. As a result of an adaptation of the individual step sizes to the "learned" feedback path, such as is performed in the third scenario (lower line 20), the incorrect adaptations were able to be reduced further again, wherein the mean value for the system entity is now only 0.14. The sole severe incorrect adaptation, caused by a drastic change in the feedback path, is found here at a point in time of approximately 4.3 seconds. However, the system distance representing the incorrect adaptations can no longer be reproduced at all by the diagram in FIG. 7 at this point in time for the other two scenarios for scaling reasons. It thus becomes clear that the proposed method considerably improves the stability in the suppression of feedback.

Although the invention has been more specifically illustrated and described in detail by means of the preferred exemplary embodiment, nevertheless the invention is not restricted by the examples disclosed and other variations can be derived therefrom by the person skilled in the art, without departing from the scope of protection of the invention.

The invention claimed is:

1. A method for reducing feedback in a hearing aid device, the hearing aid device including an acousto-electric transducer, a signal processing device, a feedback suppression device and an electro-acoustic transducer, which comprises the following steps of:

ascertaining a first feedback transfer function on a feedback path from the signal processing device via the electro-acoustic transducer, an acoustic signal path from the electro-acoustic transducer to the acousto-electric transducer and via the acousto-electric transducer back to the signal processing device;

determining a plurality of impulse response parameters in a manner dependent on amplitude absolute values of the first feedback transfer function;

estimating a second feedback transfer function by means of an adaptive filter wherein coefficients of the adaptive filter are updated in a manner dependent on the impulse response parameters, wherein an adaptation speed of the adaptive filter is formed in dependence on the impulse response parameters; and applying the adaptive filter to a signal derived from an acoustic input signal of the acousto-electric transducer.

2. The method according to claim 1, which further comprises ascertaining parameters by a smoothing function of amplitude absolute values in a manner dependent on the first feedback transfer function.

3. The method according to claim 2, wherein for a monotonic decrease in the amplitude absolute values in an argument of the smoothing function by means of the impulse response parameters, the adaptation speed of the adaptive filter is reduced in a parameter region of the amplitude absolute values in which the monotonic decrease is taking place.

4. The method according to claim 3, which further comprises updating the coefficients of the adaptive filter by means of a normalized least mean squares algorithm, wherein entries of a vector-valued step size of the NLMS algorithm for updating the coefficients of the adaptive filter are formed on a basis of the impulse response parameters and wherein the impulse response parameters are ascertained on a basis of a smoothing function of the amplitude values in a manner dependent on the first feedback transfer function.

5. A hearing aid device, comprising:

an acousto-electric transducer;

a signal processing device;

a feedback suppression device having an adaptive filter;

an electro-acoustic transducer;

wherein the hearing aid device being configured to:

ascertain a first feedback transfer function on a feedback path from said signal processing device via said electro-acoustic transducer, an acoustic signal path from said electro-acoustic transducer to said acousto-electric transducer and via said acousto-electric transducer back to said signal processing device;

determine a plurality of impulse response parameters in a manner dependent on amplitude absolute values of the first feedback transfer function;

estimate a second feedback transfer function by means of said adaptive filter, wherein coefficients of said adaptive filter being updated in a manner dependent on the impulse response parameters, wherein an adaptation speed of the adaptive filter is formed in dependence on the impulse response parameters; and apply said adaptive filter to a signal which is derived from an acoustic input signal of said acousto-electric transducer.

6. The hearing aid device according to claim 5, wherein the hearing aid device is designed to ascertain a multiplicity of feedback transfer functions at different points in time.

7. The hearing aid device according to claim 5, wherein said feedback suppression device is part of said signal processing device.

8. The hearing aid device according to claim 5, wherein the hearing aid device is further configured to:

ascertain in a plurality of disjoint or partly overlapping frequency ranges, the first feedback transfer function on the feedback path from said signal processing device via said electro-acoustic transducer, said acoustic signal path from said electro-acoustic transducer to said acousto-electric transducer and via said acousto-electric transducer back to said signal processing device.

* * * * *